US008281606B2

(12) United States Patent
Vonderhaar et al.

(10) Patent No.: US 8,281,606 B2
(45) Date of Patent: Oct. 9, 2012

(54) REFRIGERATOR VACUUM STORAGE SYSTEM

(75) Inventors: John J. Vonderhaar, Saint Joseph, MI (US); Douglas David LeClear, Benton Harbor, MI (US); Paul B. Allard, Stevensville, MI (US); Kelly M. Hanson, Euclid, OH (US); Michele E. Wilcox, Stevensville, MI (US); Andrew Michael Tenbarge, Saint Joseph, MI (US); Karen J. Querfurth, Coloma, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 735 days.

(21) Appl. No.: 12/026,870

(22) Filed: Feb. 6, 2008

(65) Prior Publication Data

US 2009/0194193 A1 Aug. 6, 2009

(51) Int. Cl.
*F25B 19/00* (2006.01)

(52) U.S. Cl. ..... 62/100

(58) Field of Classification Search ..... 62/3.7, 62/78, 100, 131, 169, 268, 331, 382, 388; 141/65, 98; 426/231; 53/512
See application file for complete search history.

(56) References Cited

U.S. PATENT DOCUMENTS

| | | | | |
|---|---|---|---|---|
| 2,388,746 | A * | 11/1945 | Knapp | 34/90 |
| 2,894,845 | A | 7/1959 | Stoddard | |
| 3,116,610 | A * | 1/1964 | Whitmore | 62/100 |
| 3,216,214 | A | 11/1965 | Gasbarro | |
| 5,088,293 | A | 2/1992 | Itou | |
| 5,095,717 | A * | 3/1992 | Germi | 62/382 |
| 5,157,940 | A | 10/1992 | Bertu et al. | |
| 5,271,240 | A | 12/1993 | Detrick et al. | |
| 5,628,404 | A * | 5/1997 | Hendrix | 206/524.8 |
| 5,946,919 | A | 9/1999 | McKinney et al. | |
| 6,090,422 | A * | 7/2000 | Taragan et al. | 426/231 |
| 6,148,875 | A | 11/2000 | Breen | |
| 7,048,136 | B2 * | 5/2006 | Havens et al. | 220/212 |
| 7,325,409 | B2 | 2/2008 | Espinosa | |
| 7,895,848 | B2 | 3/2011 | Espinosa | |
| 2003/0140603 | A1 | 7/2003 | Krasenics, Jr. et al. | |
| 2005/0028494 | A1 | 2/2005 | Higer et al. | |
| 2005/0036718 | A1 | 2/2005 | Wu et al. | |
| 2005/0172577 | A1 | 8/2005 | Oltrogge | |
| 2005/0205455 | A1 | 9/2005 | Harrison | |

(Continued)

FOREIGN PATENT DOCUMENTS

DE 10248510 A1 4/2004

(Continued)

*Primary Examiner* — Frantz Jules
*Assistant Examiner* — Emmanuel Duke
(74) *Attorney, Agent, or Firm* — Kirk W. Goodwin; Diederiks & Whitelaw PLC

(57) ABSTRACT

A vacuum storage system in a refrigerator includes a bin or drawer unit removably received in a housing. The vacuum storage system may be utilized in a storage configuration or in a vacuum sealing configuration to remove air from one or more food preservation containers having one-way evacuation valves. A switch on a control interface actuates a vacuum source and a front wall of the bin or drawer unit seals against the cabinet. Air is drawn from the storage space via a hose in communication with the vacuum source and air pressure within the storage space is reduced below atmospheric pressure, whereby air is simultaneously evacuated from the containers housed in the storage space. At a predetermined pressure, a control deactivates the vacuum source and an equalizing valve is opened to return the storage space to atmospheric pressure.

19 Claims, 3 Drawing Sheets

U.S. PATENT DOCUMENTS

| | | | | |
|---|---|---|---|---|
| 2006/0010890 | A1 | 1/2006 | Feinauer et al. | |
| 2006/0090427 | A1 | 5/2006 | Hau et al. | |
| 2006/0218885 | A1 | 10/2006 | Higer et al. | |
| 2006/0283148 | A1 | 12/2006 | Zimmerman et al. | |
| 2008/0006041 | A1* | 1/2008 | Nakata | 62/131 |

FOREIGN PATENT DOCUMENTS

| | | | | |
|---|---|---|---|---|
| EP | 1591735 | A1 | | 11/2005 |
| JP | 3175251 | A | | 7/1991 |
| JP | 2001-012837 | | * | 1/2001 |
| JP | 2001012837 | A | | 1/2001 |
| KR | 1020050100126 | | * | 10/2005 |
| WO | WO0171263 | | * | 9/2001 |
| WO | 2005/057103 | A1 | | 6/2005 |

* cited by examiner

REFRIGERATOR VACUUM STORAGE SYSTEM

BACKGROUND OF THE INVENTION

1. Field of the Invention

The present invention pertains to the art of refrigerator preservation systems, and more specifically, to a vacuum storage system for domestic refrigerators.

2. Description of the Related Art

It is well known that exposure to oxygen over time promotes deterioration of food products. Therefore, packaging food in vacuum sealed containers aids in preserving food products and extending their shelf life.

Various vacuum preservations methods for foods have been developed, including numerous countertop evacuation appliances and vacuum-sealed refrigerated drawers. Counter top devices, such as Foodsaver® appliances, vacuum-seal thermoplastic bags or canisters; however, such devices must be stored in cabinets or on the counter top, taking up valuable counter or storage space. In addition, these devices must be plugged into an outlet for each use and may require multiple attempts to seal the bag or canister properly. Further, when a user wishes to remove food from a container, he/she is required to proceed with a number of cumbersome steps in order to reseal the container. Moreover, sealing wet or liquid foods within flexible bags can be difficult and messy.

U.S. Pat. No. 6,148,875 is directed to a refrigerator drawer for storing fruits and vegetables which plugs into a vacuum source in a refrigerator to evacuate air therefrom. The drawer contains a mechanism to release the pressure in order to open the drawer and retrieve the food. Notably, every time a user opens the drawer to retrieve food, the vacuum source must be re-activated in order to evacuate air from the drawer.

U.S. Patent Application Publication No. 2006/0090427 is directed to a refrigerator including an integral vacuum sealer that connects to bags and containers via multiple hoses attached to a vacuum source inside the refrigerator. Multiple hoses within a refrigerator compartment are inconvenient and bulky. In addition, when a user desires to evacuate the air from multiple containers, he/she must plug a separate hose into each container before switching on a vacuum source. Furthermore, improper positioning of the hoses with the vacuum ports on the containers may result in little or no evacuation being achieved.

Based on the above, there remains a need in the art for a refrigerator vacuum sealing and storage assembly that permits the simultaneous evacuation of numerous containers without multiple connection steps, and that does not require activation of a vacuum source every time a user desires to remove food from the assembly.

SUMMARY OF THE INVENTION

The present invention is directed to a refrigerator vacuum storage system and method of use. The vacuum storage system includes a cabinet and a bin, such as a drawer unit, which is mounted in the cabinet to define a removable storage space for food products. An optional shelf having air flow apertures therein may be utilized to divide the storage space into separate storage compartments. The bin or drawer unit can be used to store food in a conventional manner, or may be utilized to remove air from containers to enhance food preservation within the containers. To this end, a vacuum source in a machine compartment of the refrigerator is placed in communication with the storage space. When desired, containers to be evacuated are placed into the storage space and the vacuum source is actuated via a control interface on the cabinet. Air pressure within the storage space is reduced, thereby evacuating air from within each of the containers. After a predetermined pressure is attained, or upon actuation of a stop switch, the vacuum source is shut off and an equalizing valve is opened which returns the storage space to atmospheric pressure, while vacuum conditions are retained in the containers.

With this system, a consumer is provided with a food storage bin or drawer that may be shifted between an extended or opened position and a retracted or closed position with ease, but which also may be utilized to simultaneously evacuate air from one or more containers, depending on a consumer's needs. Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF A PREFERRED EMBODIMENT

Figure 1:
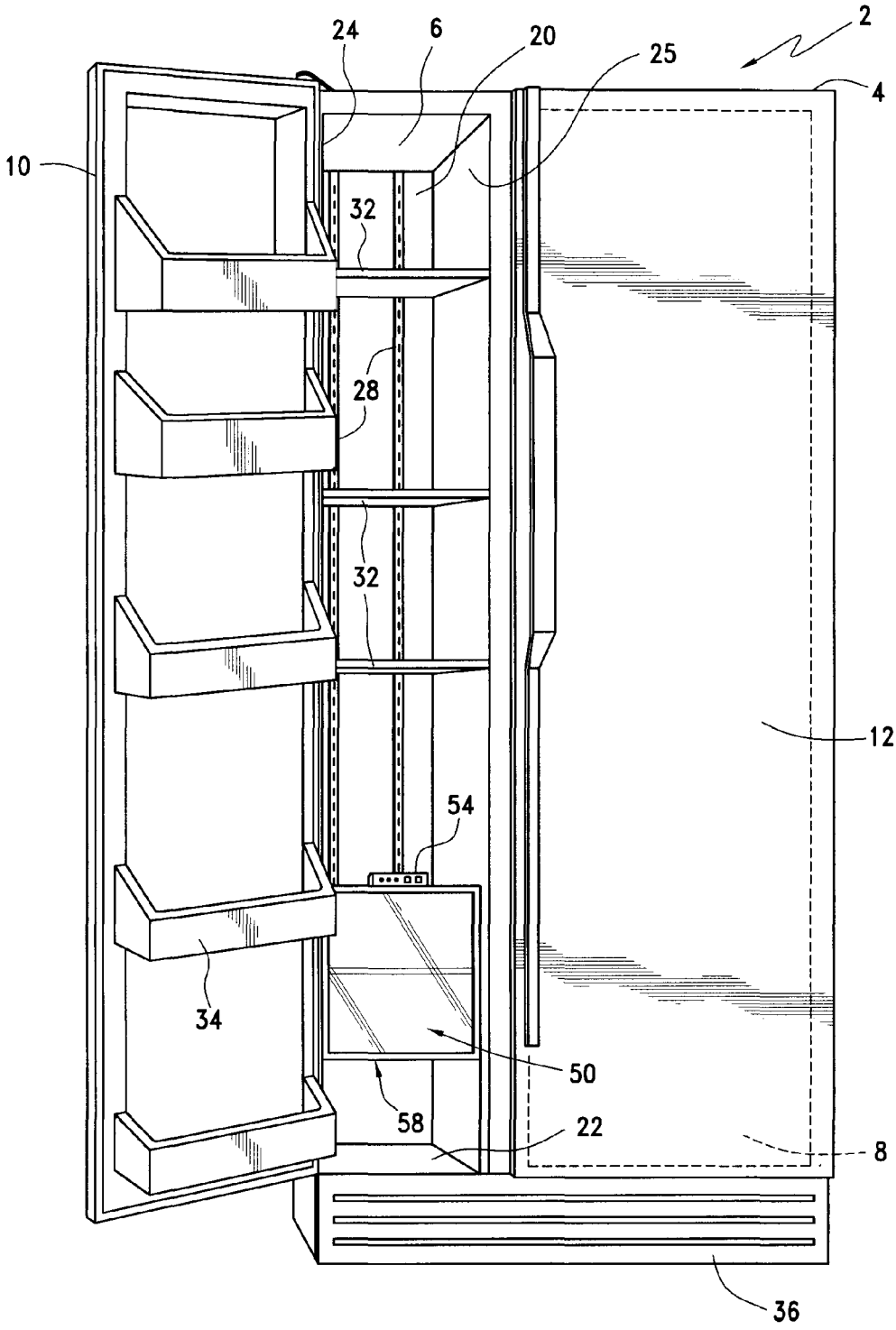
FIG. 1 is a perspective view of a side by side refrigerator showing the inside of a freezer compartment including a vacuum storage system of the present invention.

With initial reference to FIG. 1, a refrigerator is indicated at 2. Refrigerator 2 includes a cabinet 4 having a freezer compartment 6 and a fresh food compartment 8. In the embodiment shown, refrigerator 2 is constituted by a side-by-side refrigerator. However, as will become more fully evident below, the present invention is equally applicable to other types of refrigerators. As illustrated, freezer compartment 6 can be selectively accessed through a freezer door 10, while fresh food compartment 8 can be selectively accessed through a fresh food door 12. As is known in the art, freezer compartment 6 is defined in part by back wall 20, bottom wall 22 and opposing side walls 24 and 25. A set of rails 28 is provided on back wall 20 for supporting various, vertically spaced shelf units 32. Freezer door 10 also includes numerous bins 34 incorporated therein. In a manner known in the art, refrigerator 2 also includes a kick plate 36 arranged at a bottom portion thereof, in front of a machine compartment 38 for housing various components, such as a compressor and condenser, of a refrigeration system for the refrigerator in a manner known in the art.

Figure 2:
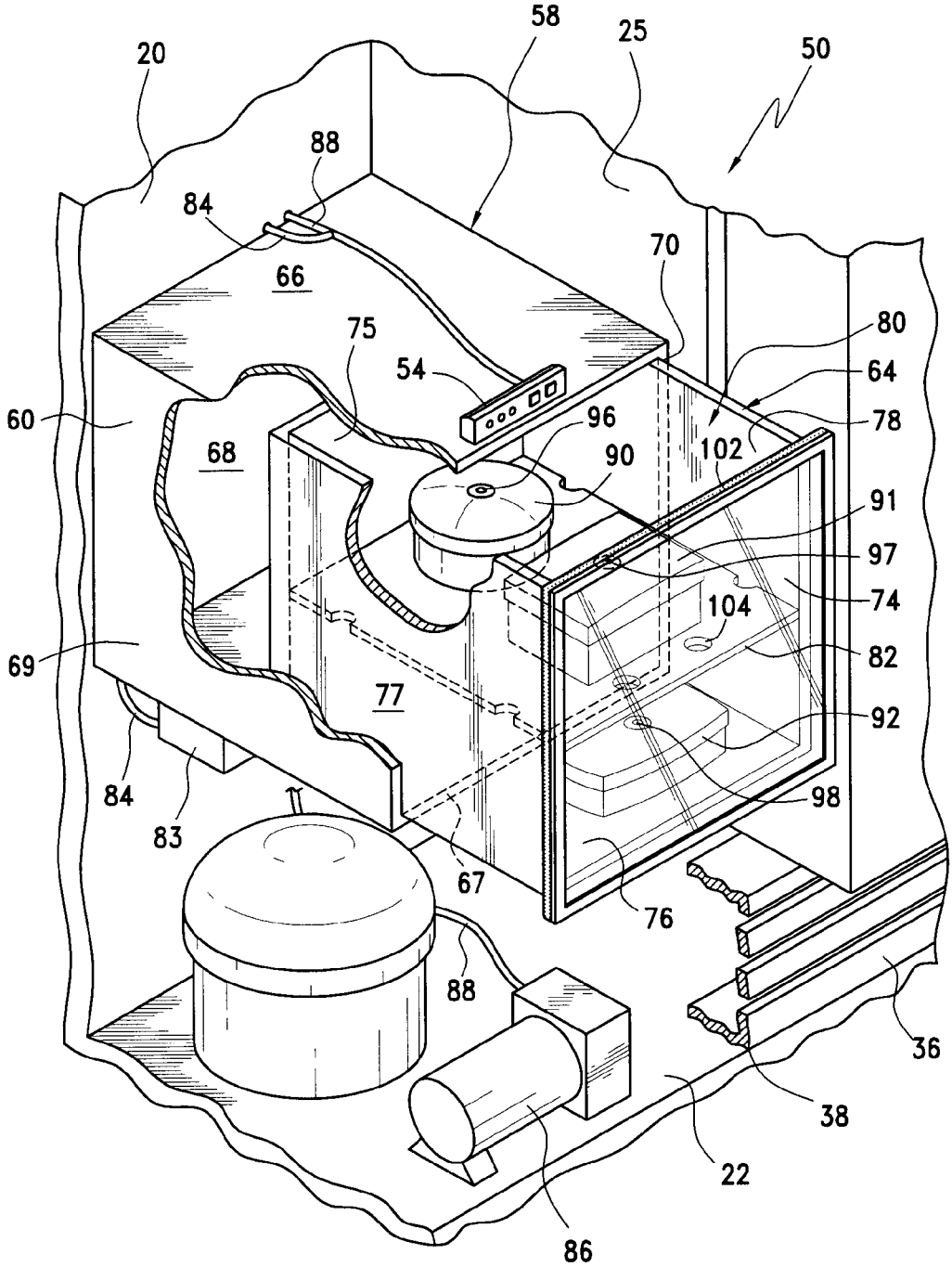
FIG. 2 is a perspective view of the vacuum storage system of FIG. 1 with the bottom wall of the freezer compartment removed.
Figure 3:
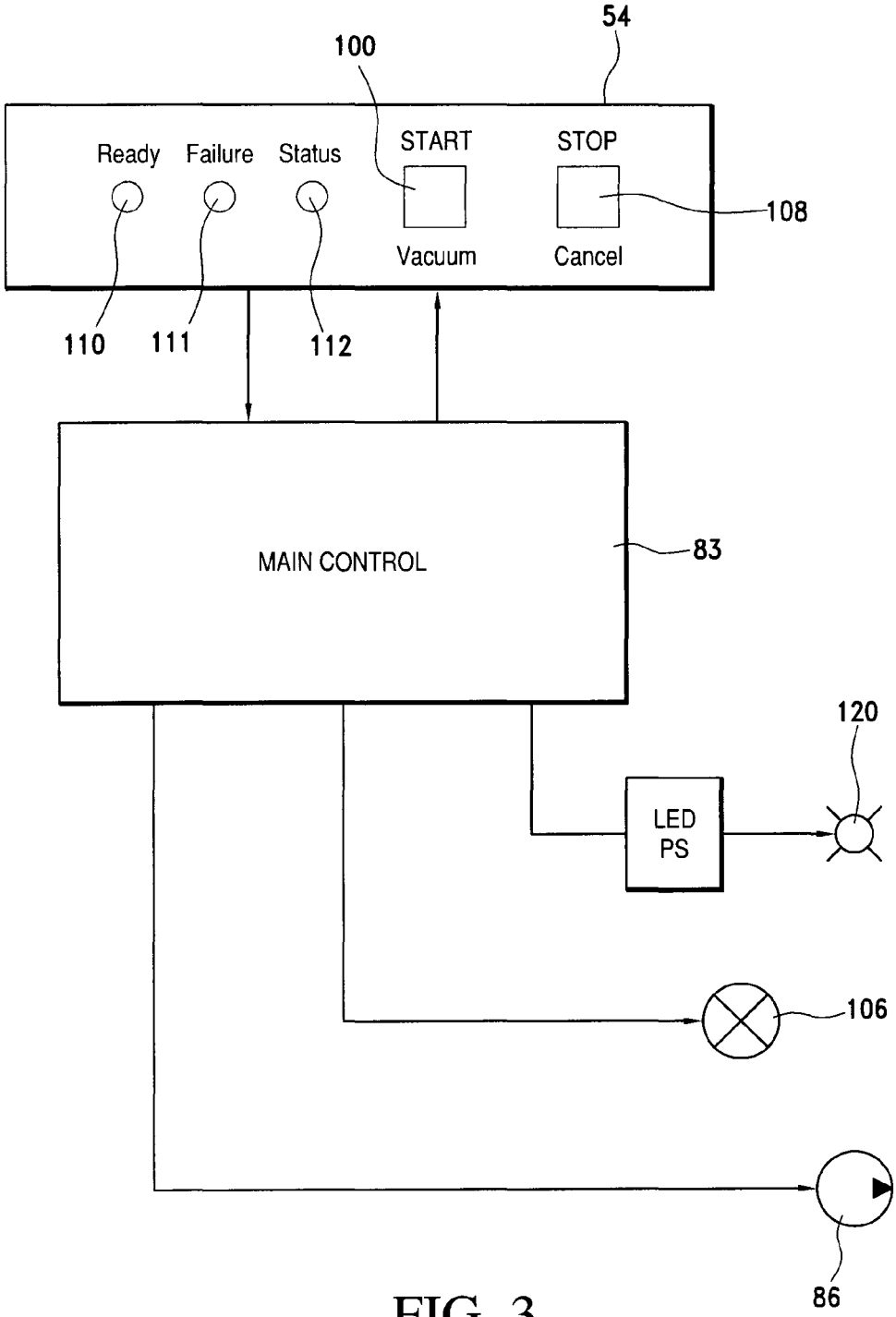
FIG. 3 is a schematic depiction of the vacuum storage system of the present invention.

In accordance with the present invention, a vacuum storage system 50 is located within refrigerator 2. Although depicted as residing in freezer compartment 6, it should be readily understood that vacuum storage system 50 could be located within fresh food compartment 8. In the preferred embodiment shown in FIG. 2, vacuum storage system 50 includes a control interface 54 and a storage assembly 58 comprising a cabinet 60 and a slide-out drawer unit 64. Cabinet 60 includes top, bottom, back and opposing side walls 66-70. Likewise, drawer unit 64 includes front, back, bottom and opposing side walls 74-78 defining a storage space 80. Drawer unit 64 may optionally include a shelf 82 within storage space 80 to divide storage space 80 into multiple storage compartments. Control interface 54 is located on top wall 66 of cabinet 60 and is in communication with a main control 83 (FIG. 3) via wires 84. Main control 83 also communicates with a vacuum source or pump 86, which is in fluid communication with storage space 80 via a hose 88. In a preferred embodiment of the invention, vacuum pump 86 is located in machine compartment 38 as depicted in FIG. 2. Advantageously, the placement of vacuum pump 86 within machine compartment 38 reduces the noise level of vacuum storage system 50 during an evacuation event. Storage containers 90-92, which are adapted to be utilized in conjunction with vacuum storage system 50, include respective one-way evacuation valves 96-98 that only allow air to be removed from the containers 90-92. As will be discussed more fully below, a user may selectively evacuated air from drawer unit 64 utilizing control unit 54, thereby simultaneously vacuum sealing storage containers 90-92.

With reference to FIG. 2, a user may choose to utilize drawer unit 64 in a conventional manner to store food products and/or may choose to evacuate air from containers. More specifically, in a standard storage configuration, drawer unit 64 may be opened or closed as needed to access food products stored in storage space 80. When a user wishes to use the food preservation aspect of vacuum storage system 50, the user simply inserts one or more vacuum sealing storage containers, such as containers 90-92 including one-way valves 96-98, into storage space 80, closes drawer unit 64, and actuates a vacuum sealing event utilizing switch 100 (best seen in FIG. 3). Although hard containers 90-92 are depicted, it should be understood that any type of one-way valve container may be utilized with the present invention, including bags.

When vacuum storage system 50 is in an evacuation configuration, a seal if formed between the front wall 74 of drawer unit 64 and side walls 66-70 of cabinet 60, and air is removed from storage space 80 via hose 88, lowering the pressure within storage space 80 below atmospheric pressure. Preferably, a deformable seal 102 is incorporated around the periphery of front wall 74 of drawer unit 64. Alternatively, a seal (not shown) may be incorporated about the periphery of cabinet 60, or the construction of drawer unit 64 and cabinet 60 may be conducive to maintaining an adequate seal there between during an evacuation event without a separate seal. When shelf 82 is utilized, fluid flow apertures 104 in shelf 82 allow for airflow between the established, multiple storage compartments. One-way valves 96-98 of respective containers 90-92 allow air to simultaneously leave the containers as air is evacuated from storage space 80. When storage space 80 reaches a set atmospheric pressure, main control 83 turns off vacuum pump 86 and an equalizing valve 106 is opened to allow storage space 80 to equalize to atmospheric pressure, such that drawer unit 64 can be readily opened by a consumer. Alternatively, a stop switch 108 may be utilized to cancel an evacuation event or the evacuation event may be stopped after a predetermined time period has elapsed.

Control interface 54 preferably has a number of indicators, such as light emitting diodes (LEDs) 110-112, to communicate the status of an evacuation event to a consumer. Control interface 54 is in communication with a power source 120 through main control 83, which is utilized to power LEDs 110-112. Additionally, control interface 54 may include environmental controls for further controlling the conditions within storage space 80. For example, if vacuum storage system 50 is positioned within fresh food compartment 8, environmental controls such as the ones employed by U.S. Pat. No. 6,170,276, hereby incorporated by reference, may be utilized.

Advantageously, the vacuum storage system 50 of the present invention can be utilized as a pull-out storage drawer that can be accessed in a standard manner, or as a vacuum inducing drawer to evacuate air from one or more storage containers. More specifically, storage space 80 can be opened numerous times by a consumer without the need to utilize the vacuum features of the system every time storage space 80 is accessed. Additionally, vacuum storage system 50 may be utilized to vacuum seal only one vacuum seal container (90-92), or multiple containers simultaneously, depending on a consumers needs.

Although described with reference to a preferred embodiment of the invention, it should be readily understood that various changes and/or modifications can be made to the invention without departing from the spirit thereof. For instance, although only one vacuum storage system 50 is depicted, it should be readily understood that two or more systems may be positioned within one or more compartments of refrigerator 2. In addition, a compartment incorporating the vacuum storage system 50 could be made readily movable between multiple locations within the refrigerator such that the height and lateral location could be customized by the consumer. Furthermore, although the preferred embodiment discussed has vacuum storage system 50 incorporating a bin in the form of a drawer, other types of storage bins, such as pivoting bins, could be employed. In general, the invention is only intended to be limited by the scope of the following claims.

What is claimed is:

1. A refrigerator comprising: a machine compartment; a food storage compartment; and a vacuum storage system within the food storage compartment adapted to be utilized in a storage configuration or a vacuum sealing configuration, said vacuum storage system including: a cabinet; drawer unit supported for movement between retracted and extended positions into and out of the cabinet, said drawer unit including a plurality of interconnected walls defining a storage space, one of the plurality of interconnected walls constituting a front wall; one or more vacuum sealing containers each provided with a one-way evacuation valve; a vacuum source in communication with the storage space inside of the cabinet reducing air pressure within the storage space below atmospheric pressure during an evacuation event; a control system establishing the evacuation event through selective activation of the vacuum source wherein, upon placing the one or more vacuum sealing containers in the drawer unit, and actuating the vacuum source, the air pressure in the storage space is reduced below atmospheric pressure simultaneously causing air pressures in the one or more vacuum sealing containers to be reduced below atmospheric pressure, whereupon the control system automatically deactivates the vacuum source upon establishing a reduced air pressure within the drawer unit and enables the pressure in the storage space to increase while the sealing containers remain under vacuum conditions; and an equalizing valve in communication with the storage space automatically returning the storage space to atmospheric pressure after the evacuation event.

2. The refrigerator of claim 1, wherein the vacuum source is located in the machine compartment of the refrigerator.

3. The refrigerator of claim 1, wherein the vacuum storage system further includes environmental controls for regulating a desired temperature within the storage space.

4. The refrigerator of claim 1, wherein the control system of the vacuum, storage system includes a user control interface having at least one status indicator for the evacuation event.

5. The refrigerator of claim 1, wherein the vacuum storage system further includes a shelf positioned in the drawer unit and dividing the storage space into multiple storage compartments.

6. The refrigerator of claim 5, wherein the shelf includes a plurality of fluid flow apertures.

7. The refrigerator of claim 1, wherein the vacuum storage system further includes a seal located on a periphery of the front wall of the drawer unit.

8. A vacuum storage system for a refrigerator food storage compartment including: a cabinet; a drawer unit slidably supported for movement between retracted and extended positions into and out of the cabinet, said drawer unit including a plurality of interconnected walls defining a storage space, one of the plurality of interconnected walls constituting a front wall; one or more vacuum sealing containers each provided with a one-way evacuation valve; a vacuum source in communication with the storage space inside of the cabinet reducing air pressure within the storage space below atmospheric pressure during an evacuation event; a control system establishing the evacuation event through activation of the vacuum source wherein, upon placing the one or more vacuum sealing containers in the drawer unit and actuating the vacuum source, the air pressure in the storage space is reduced below atmospheric pressure simultaneously causing air pressures in the one or more vacuum sealing containers to be reduced below atmospheric pressure, whereupon the control system automatically deactivates the vacuum source upon establishing a reduced air pressure within the drawer unit and enables the pressure in the storage space to increase while the sealing containers remain under vacuum conditions; and an equalizing valve in communication with the storage space automatically returning the storage space to atmospheric pressure after the evacuation event.

9. The vacuum storage system of claim 8, further including environmental controls for regulating a desired temperature within the storage space.

10. The vacuum storage system of claim 8, wherein the control system includes a user control interface having at least one status indicator for the evacuation event.

11. The vacuum storage system of claim 8, further including a shelf positioned in the drawer unit, and dividing the storage space into multiple storage compartments.

12. The vacuum storage system of claim 11, wherein the shelf includes a plurality of fluid flow apertures.

13. The vacuum storage system of claim 8, further including a seal located on a periphery of the front wall of the drawer unit.

14. A method of vacuum preserving food in a refrigerator utilizing a vacuum storage system including a cabinet and a drawer unit removeably disposed therein, the method comprising: inserting one or more containers each having a one-way evacuation valve into a storage space defined by the drawer unit; closing and sealing the drawer unit; actuating through a control system a vacuum source in communication with the storage space to reduce an air pressure within the storage space to a pressure below atmospheric pressure during an evacuation event, wherein air is simultaneously drawn out of the one or more containers via a respective said one-way evacuation valve; and automatically de-activating the vacuum source through said control system upon establishing a reduced air pressure within the drawer unit to allow the air pressure within the storage space to increase while the one or more containers remain under vacuum conditions.

15. The method of claim 14, further comprising: selectively supporting each of the one or more containers either upon or below a shelf provided in the drawer unit; and permitting air to flow within the storage space through apertures provided in the shelf.

16. The method of claim 14, further comprising:

indicating a status of the evacuation event on a control interface.

17. The refrigerator of claim 1 wherein the front wall provides a vacuum seal against the cabinet when the drawer unit assumes the retracted position.

18. The vacuum storage system of claim 8 wherein the front wall provides a vacuum seal against the cabinet when the drawer unit assumes the retracted position.

19. The method of claim 14, further comprising inserting two containers each having a one-way evacuation valve into the storage space.

* * * * *